US006449785B1

(12) United States Patent
Liljedahl

(10) Patent No.: US 6,449,785 B1
(45) Date of Patent: Sep. 17, 2002

(54) AID FOR DISABLED PERSONS TO STAND UP

(75) Inventor: Gunnar Liljedahl, Luleå (SE)

(73) Assignee: Liko Research & Development AB, Luleå (SE)

( * ) Notice: Subject to any disclaimer, the term of this patent is extended or adjusted under 35 U.S.C. 154(b) by 0 days.

(21) Appl. No.: 09/926,136

(22) PCT Filed: Dec. 22, 1999

(86) PCT No.: PCT/SE99/02472

§ 371 (c)(1),
(2), (4) Date: Sep. 7, 2001

(87) PCT Pub. No.: WO00/54722

PCT Pub. Date: Sep. 21, 2000

(30) Foreign Application Priority Data

Mar. 12, 1999 (SE) ..... 9900895

(51) Int. Cl.[7] ..... A61G 7/10

(52) U.S. Cl. ..... 5/89.1; 5/87.1; 5/86.1; 5/83.1

(58) Field of Search ..... 5/86.1, 81.1 R, 5/83.1, 85.1, 87.1, 89.1

(56) References Cited

U.S. PATENT DOCUMENTS

| | | | | | |
|---|---|---|---|---|---|
| 2,821,406 | A | * | 1/1958 | Hoyer et al. | 5/83.1 X |
| 2,903,238 | A | * | 9/1959 | Flandrick | 5/83.1 X |
| 2,959,791 | A | * | 11/1960 | Ramsey | 5/86.1 |
| 3,137,011 | A | * | 6/1964 | Fischer | 5/86.1 |
| 3,222,029 | A | * | 12/1965 | Hildemann | 5/86.1 X |
| 3,234,568 | A | * | 2/1966 | Fischer | 5/89.1 |
| 3,252,704 | A | * | 5/1966 | Wilson | 5/83.1 X |
| 3,623,169 | A | * | 11/1971 | James | 5/87.1 |
| 3,694,829 | A | * | 10/1972 | Bakker | 5/87.1 |
| 3,877,421 | A | * | 4/1975 | Brown | 5/87.1 X |
| 4,070,721 | A | * | 1/1978 | Stasko | 5/89.1 |
| 4,117,561 | A | * | 10/1978 | Zamotin | 5/83.1 |
| 4,484,366 | A | * | 11/1984 | Koontz | 5/83.1 |
| 4,682,377 | A | * | 7/1987 | Reich | 5/83.1 |
| 4,712,257 | A | * | 12/1987 | James | 5/83.1 |
| 4,742,588 | A | * | 5/1988 | James | 5/83.1 |
| 4,918,771 | A | | 4/1990 | James | 5/81 |
| 4,947,497 | A | * | 8/1990 | Marchand | 5/86.1 |
| 5,365,621 | A | * | 11/1994 | Blain | 5/87.1 |
| 5,396,670 | A | * | 3/1995 | Firebaugh et al. | 5/89.1 |
| 5,502,851 | A | * | 4/1996 | Costello | 5/86.1 |
| 5,530,975 | A | * | 7/1996 | Firebaugh et al. | 5/89.1 X |
| 5,946,748 | A | * | 9/1999 | Wang | 5/81.1 R |
| 6,079,062 | A | * | 6/2000 | Mullin | 5/89.1 |
| 6,175,973 | B1 | * | 1/2001 | Hakamiun et al. | 5/89.1 |
| 6,289,534 | B1 | * | 9/2001 | Hakamiun et al. | 5/89.1 |
| 6,321,398 | B1 | * | 11/2001 | Wang | 5/81.1 R |

FOREIGN PATENT DOCUMENTS

| | | | | | |
|---|---|---|---|---|---|
| DE | 2132566 | A | * | 1/1973 | 5/87.1 |
| DE | 2408022 | A | * | 8/1975 | 5/87.1 |
| FR | 2414909 | A | * | 8/1979 | 5/87.1 |
| FR | 2461492 | A | * | 3/1981 | 5/87.1 |
| GB | 867149 | A | * | 5/1961 | 5/87.1 |
| GB | 1282274 | A | * | 7/1972 | 5/87.1 |
| GB | 2182275 | A | * | 7/1972 | 5/87.1 |

OTHER PUBLICATIONS

Excerpt entitled "Molift Partner" from a brochure presented by Actuator AS, dated Oct. 8, 1993.*

* cited by examiner

*Primary Examiner*—Robert G. Santos
(74) *Attorney, Agent, or Firm*—Jacobson Holman, PLLC

(57) ABSTRACT

Aid apparatus for raising a disable person from a sitting position to a standing position including a wheeled base (1) in the form of a U-shaped frame with a post (3), which supports a lifting arm arrangement (5, 7), to which can be attached a lifting sling (9), which surrounds at least partly the body of the person. The object is now to avoid that the person will be lifted in his armpits and also to make the lifting motion stable. The lifting arm arrangement (5, 7) therefore includes two arms (7), the free ends of which have a hook (8), in which a belt (9) having four bands (10, 11, 16, 17) can be hooked on in such a way that the belt surrounds the person overlapped just under breast-high.

2 Claims, 2 Drawing Sheets

AID FOR DISABLED PERSONS TO STAND UP

This is a nationalization of PCT/SE99/02472 filed Dec. 22, 1999 and published in English.

This invention relates to an aid apparatus for lifting a disabled person from a sitting to a standing position comprising a wheeled base in form of a U-shaped frame, with a post, which supports a lifting means, to which a lifting sling can be fastened, which sling is applied at least partly around the body of the person, and which lifting means includes a lifting arm arrangement having a free end, which can be raised and lowered in relation to the base and supports the lifting sling.

An apparatus of this kind is known from e.g. SE-A-8402899-2. By this known apparatus the person is lifted from a sitting position to a standing position by means of two swinging arms attached to the post and a sling, which is fixed to the swinging arms and is extended from one of the swinging arms downwards under the first armpit of the person, further around the back of the person and under the second armpit and up to the second swinging arm. By that the person is lifted under the armpits, the armpits will be heavily effected and could trouble and be very uncomfortable to the person. This goes specifically for persons having weak arms and legs, who are those, needing such an aid apparatus in order to get up. It has now been shown that the best point of application of the lifting action is at the front side of the person as close to the centre of gravity as possible. The way of application shall also include points of application at the two sides of the person so that the lifting action is lateral stabilised. Further it is of importance that the point of application is fixed during the lifting action so that the person feels safe.

The above stated objects are achieved by that the invention has been given the characterizing features, which are stated in the following claims.

An embodiment of the invention will now be described with reference to enclosed drawings.

Figure 1:
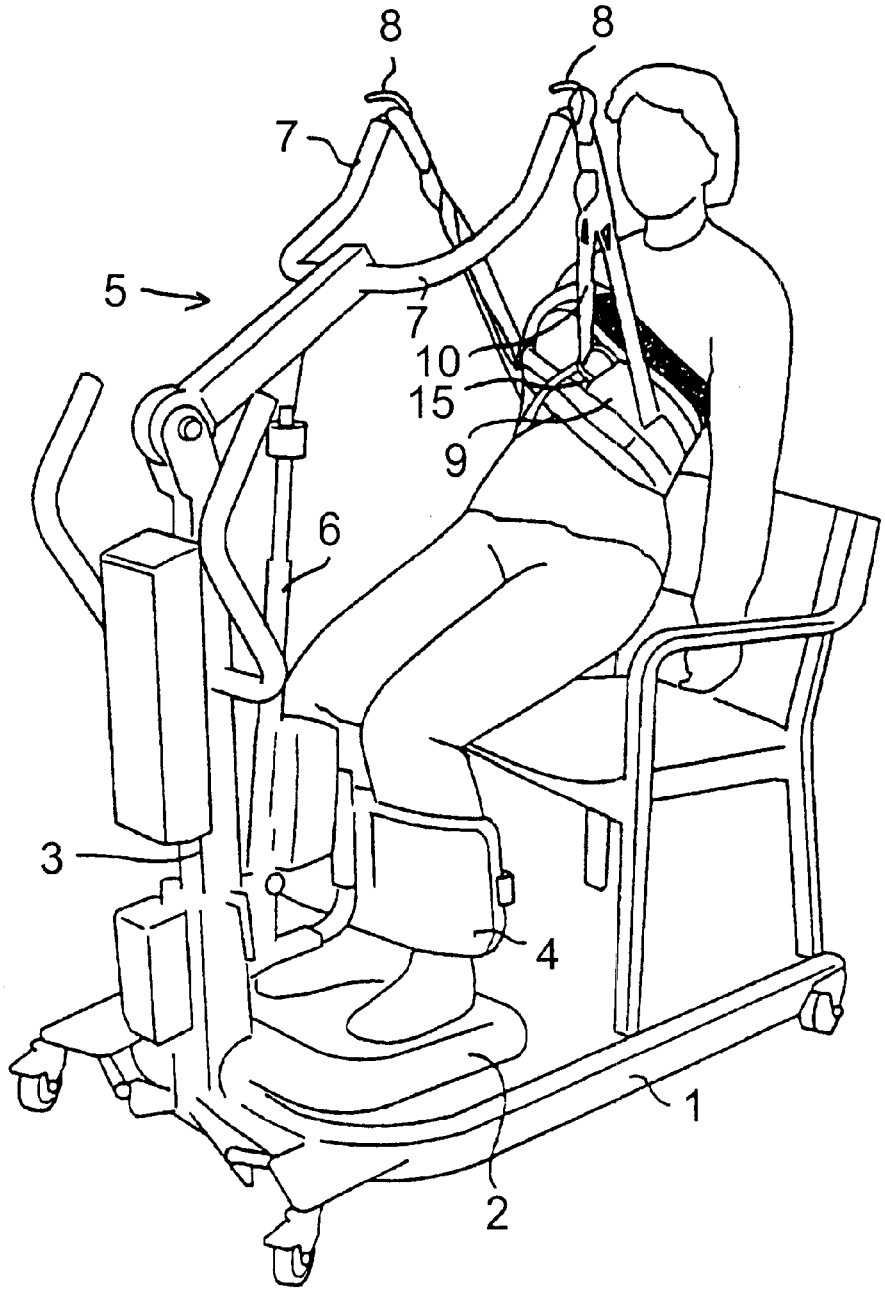
FIG. 1 is hereby a radial projection of an embodiment of the invention.

FIG. 1 thus shows an apparatus according to the invention. The apparatus includes a wheeled base 1, which is a U-shaped frame. The base supports a footplate 2 and a post 3. The post supports in its lower part a knee support 4, which is adjustable in the direction to and from the post 3. The post supports in its upper end a swinging arm 5, which swings upwards and downwards in the vertical plane by means of an electric or hydraulic driving means 6. The swinging arm 5 has an extension from its free end in the form of two arms 7, which are extended parallel to each other having a certain distance between themselves, which distance preferably is similar to the breadth across the shoulders. Each end of the arms 7 have a hook 8, from which is suspended a lifting sling in form of the lifting belt 9, see FIGS. 2 and 3.

Figure 2:
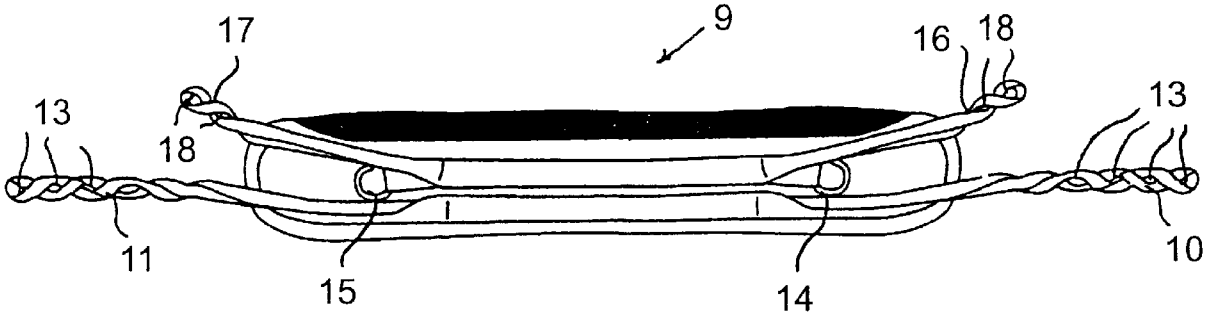
FIG. 2 is a view from behind of a lifting waist, which forms a part of the invention.

An embodiment of the belt 9, which belongs to the invention, will now be described by reference to FIGS. 2 and 3. The belt is shown in FIG. 2 seen from behind. As can be seen a strap 10 is fixed to the right side of the belt and a second strap 11 is fixed to the left side of the belt. These straps have several eyes 13 at the end thereof in order to establish different points of application to a hook means.

When using the belt it is surrounded around the body of the person breast-high from behind and the straps are also surrounded the body and are inserted each through a ring 14 and 15 respectively. Thus the strap 10 is inserted through the ring 15 when the belt is surrounded the body of the person and the strap 11 is inserted through the ring 14. When thereafter the straps 10 and 11 are drawn tight, the belt will be tightened around the body of the person. The rings 14 and 15 are fixed to the belt at points, which are closer to the free ends of the belt than to the middle of the belt. See also FIG. 1, from which can be seen that the strap 10 is extended from the backside of the belt and through the ring 15.

The belt has further two lifting bands 16 and 17, which are fastened to the belt at points, which are at a distance from the ends of the belt. The lifting bands 16 and 17 have also several eyes 18 for attachment to a lifting hook. The shape of the belt is shown in FIG. 3 when the belt is surrounded the chest of a person. The free parts of the belt 9 overlap each other, whereat the strap 10 is extended over the front side of the belt and through the ring 15. In the same way the strap 11 is extended over the front side of the belt and through the ring 14. The lifting bands 17 and 18 are extended outwards from the sides, see FIG. 3.

Figure 3:
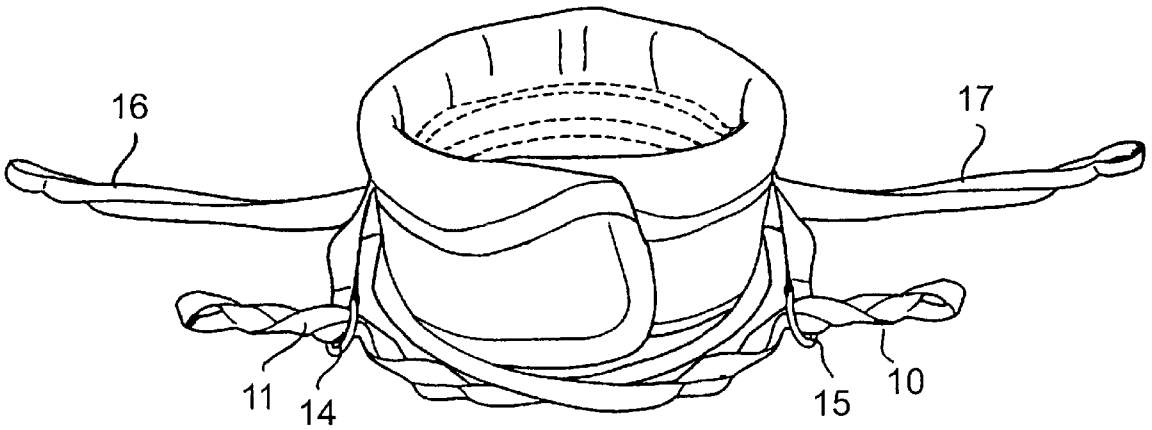
FIG. 3 is a radial projection of the lifting waist according to FIG. 2, the lifting waist being in the form when it is applied to a person.

When now a person is to be lifted from a sitting position from a chair as for instance is shown in FIG. 1, the belt is surrounded the body of the person breast-high and overlaps as shown in FIG. 3. The strap 10 is then fixed to the hook 8 in a suitable manner so that the strap is stretched. The second strap 11 is fastened to its hook 8. The two lifting bands 17 and 18 are thereafter fastened in the same way. After this, it is checked that all bands and straps are similarly stretched and depending on the size of the person breast-high the straps 10 and 11 will have different free length. If the person is very heavy, a shorter length, from the ring 14 and 15 respectively to the ends of the straps 10 and 11 respectively, is free to be used for attachment to the hook. Thus, both the lifting bands and the straps should have the same tension after being attached to its hook 8. If e.g. the two straps 10 and 11 are too slack, they shall be attached by any eye 13, which is further in on the strap. The ideal situation should be that after a certain tightening of the two straps, the belt will be fixed around the body comfortably and that thereafter the lifting action is accomplished by the lifting bands 16 and 17. By that the straps are fixed in the two hooks 8, the tension of the straps will be maintained during the lifting operation.

After that the belt has been fastened to the body of the person, when the person is in sitting position, and the eyes have been attached to the two hooks 8 the lifting operation of the person from the sitting position to standing position can be started. In FIG. 1 there is shown the position of the person soon after the lifting operation has been started. By that the two lifting bands 16, 17 have the points of application in the belt at the sides of the persons, a stable lifting operation will take place so that e.g. the person does not rotate. It is also of importance that the belt is kept in place around the chest and close to the centre of gravity of the person. This makes it possible so that in the starting position there is a possibility to lift the person straight upwards and without stress onto the legs by the knees being pressed against the knee support 4. It should be noted that there are two lifting arms 7, which have about the same mutual distance as the breadth across the shoulders of the person and this also contributes to that the lifting operation is carried out without the person being rotated.

An embodiment of the invention has been described above. Within the inventive idea other embodiments are obvious to the man skilled in the art and this goes specifically for the embodiment of the belt and the lifting arm arrangement. Instead of a swinging arm 5, 7 it is possible to make use of one arm, which is moved in a simple vertical movement. The belt includes lifting band and straps. The points of application of these to the belt may be varied within the inventive idea but it is of importance that at least the straps will tighten the belt around the body of the person by being drawn through a ring, a slit, an eye or the similar. The described embodiment shows the point of attachment of the straps and of the lifting bands to be the same but it is possible to arrange the points of application of the straps to be different from the points of the application of the lifting bands. However according to the invention the points of application of the lifting bands shall be on each side of the person when the belt is tightened.

What is claimed is:

1. Aid apparatus for raising a disabled person from a sitting position to a standing position, said apparatus includes a wheeled base (1) having the shape of a U-formed frame with a post (3) which supports a lifting means (5, 6) to which is fastened a lifting sling (9), which can be applied at least partly around the body of the person, said lifting means comprising a lifting arm arrangement (5, 7) having a free end which can be raised and lowered in relation to the base (1) and supports the lifting sling, characterized in that the lifting arm arrangement (5, 7) at least in the free end includes two arms (7) having a mutual distance, which corresponds to the breadth across the shoulders of the person and the free ends of the two arms each having a hook (8), said lifting sling comprising a belt (9) consisting of four bands (10, 11, 16, 17) which can be fastened in such a way that the belt overlaps on the chestside of the person, wherein, the bands consist of two straps (10, 11) which cross each other on the chsestside and thereafter are extended each through a ring (14, 15) which is fixed to the belt, and further consists of two lifting bands (16, 17) which both are fixed to the belt (9) on points adjacent to the chestside of the person, whereby the person can be lifted by the lifting arm arrangement from a point of application close to the chestside of the person such that one strap (10, 11) and one lifting band (16, 17) can be hooked on each hook (8).

2. The aid apparatus according to claim 1, characterized in that the straps (10, 11) and the lifting bands (16, 17) have several eyes (13, 18) next to each other at the end of the bands so that the bands can be adjusted to the same tension when being hooked on the hooks (8) of the arms (7).

* * * * *